US006628239B1

(12) United States Patent
Hilliard et al.

(10) Patent No.: US 6,628,239 B1
(45) Date of Patent: Sep. 30, 2003

(54) VARIABLE SCATTERING DEVICE

(75) Inventors: Donald Patrick Hilliard, Camarillo, CA (US); Glenda Esnardo Hilliard, Camarillo, CA (US); Michael Patrick Hilliard, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/142,746

(22) Filed: May 10, 2002

(51) Int. Cl.[7] ..... H01Q 15/00
(52) U.S. Cl. ..... 343/850; 342/5; 342/12
(58) Field of Search ..... 342/5, 6, 12, 13, 342/175; 343/850, 912

(56) References Cited

U.S. PATENT DOCUMENTS 6,456,225 B1 * 9/2002 Forster ..... 342/12

* cited by examiner

*Primary Examiner*—Michael C. Wimer
(74) *Attorney, Agent, or Firm*—David S. Kalmbaugh

(57) ABSTRACT

A variable scattering device comprising a object which may be an antenna, a load impedance which is optimal and a switch which connects the scattering object to the load impedance. By using the switch to switch the load impedance in and out of the connection with the scattering object a large dynamic range for a fluctuating scattered signal may be achieved.

23 Claims, 4 Drawing Sheets

VARIABLE SCATTERING DEVICE

BACKGROUND OF THE INVENTION

1. Field of the Invention

The present invention relates generally to scattering devices that reflect electromagnetic signals. More particularly, the present invention relates to an apparatus which enhances the performance of scattering devices by increasing the amplitude of the time variations in a reflected signal which includes information such an identification code.

2. Description of the Prior Art

In the past conventional scattering devices consisted generally of a plurality of single strand dipole elements. Examples of conventional scattering devices include chaff, reflector beacons used on aircraft, and corner reflectors used on boats and by hikers. Conventional scattering devices such as chaff, decoys and reflector beacons that receive an incident electro-magnetic signal, reflect a constant amplitude signal with time.

State of the art missile seekers are capable of distinguishing between chaff from a moving aircraft by utilizing Doppler rejection algorithms. The Doppler rejection algorithms are capable of distinguishing chaff from moving aircraft because of the significant reduction in chaff velocity when compared to the velocity of a moving aircraft.

Static reflectors used on boats, bicycles and individuals who are, for example, runners wearing reflectors generate static reflection signals that may not be identifiable from clutter background reflections. Static reflectors generally do not include a method for identification of the person or vessel to which the reflector is attached.

Current approaches to radio frequency tagging lack adequate modulation signal strength to be used at long range, for example, several miles or in a cluttered environment.

Further, currently calibration devices used for Doppler reflection test, such as jet engine modulation, lack the dynamic range that would produce high quality test results.

Accordingly, there is a need for an apparatus for varying the reflection properties of scattering objects such as missile decoys, chaffs and towed decoys, rescue beacons, reflectors, antennas and the like. By varying the reflection properties of a scattering object, a threat missile will be less likely to distinguish a moving target, such an aircraft, from the scattering object which may be chaff or a decoy.

In addition, there is a need for a means to provide an identification code with the signal reflected from the scattering object.

SUMMARY OF THE INVENTION

The present invention comprises a scattering object, which may be, for example, an antenna, a load impedance which is optimal and a switch which connects the scattering object to the load impedance. The scattering object includes fundamental scattering characteristics, referred to as structural scattering, which arise from surface currents induced by an incident electro-magnetic or radio frequency signal. The optimal load impedance is an electrical device, such as inductor, that produces a current at the connection between the scattering object and the load impedance that has a phase and amplitude which result in a minimal scattered signal. By using the switch to switch the load impedance in and out of the connection with the scattering object a large dynamic range for a fluctuating scattered signal may be achieved.

The switch may be an electrical RF switch, a gravity operated switch, a chemical induced operating switch or a photonic switch. When an electrical RF switch has a digital processor connected thereto, the switch may be used to provide a digital identification code to the scattering object which is then transmitted by the scattering to a receiving antenna.

DETAILED DESCRIPTION OF THE PREFERRED EMBODIMENTS

Figure 1:
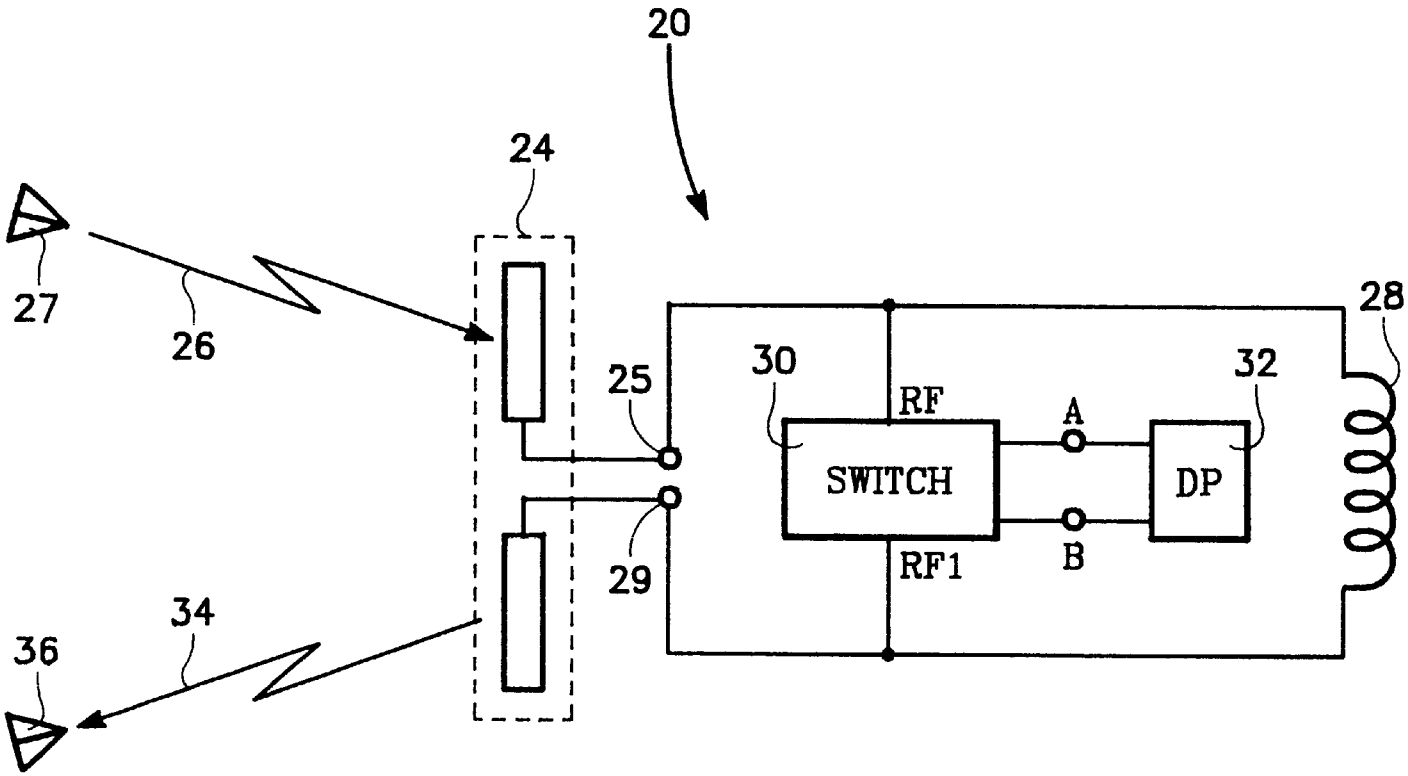
FIG. 1 is an electrical schematic diagram of a first a embodiment of a variable scattering device comprising the present invention.

Referring first to FIG. 1, there is shown a variable scattering device, which is designated generally by the reference numeral 20, which varies the reflection properties of a scattering object 24 over time. Variable scattering device 20 may be useful in a variety of applications including missile decoys, chaff and towed decoys, rescue beacons, scatter control systems and antennas adapted for use in communications systems such as cell phones.

In the embodiment illustrated in FIG. 1, variable scattering device 20 includes an antenna 24 which reflects incident RF or other electromagnetic signals 26 transmitted by a transmitting antenna 27, a load impedance 28 and a switch 30 which is in parallel with the load impedance 28. Antenna 24 is electrically connected to inductor 28 and switch 30 by a pair of terminals 25 and 29.

The load impedance 28 may be an inductor which has a positive reactance of approximately 300 Ohms. When antenna 24 is a half wave length dipole antenna, the optimum load impedance for the antenna is a positive reactance of about 300 Ohms. When the variable scattering device 20 is a full wave length dipole antenna, the optimal load impedance is a positive reactance of about 200 Ohms requiring an inductor having a reactance of about 200 Ohms. The optimal load impedance value occurs when the load impedance produces a minimum backscatter by the antenna. The optimal load would provide a reduction in back scatter by at least 30 dB (30 dB on a linear scale is a factor of 1000).

A switch 30 which may be used in the embodiment of the invention illustrated in FIG. 1 is a Model HMC132 GaAS MMIC high isolation SPDT switch manufactured by Hittite Microwave Corporation of Boston, Mass. The HMC132 switch is a fast broadband SPDT radio frequency switch with high (>50 dB) isolation over its entire band which is DC to 15 GHz.

Switch 30 includes a pair of control inputs A and B which may be connected to a digital processing unit 32. Switch 30 also has a signal input RF and a pair of signal outputs RF1 and RF2. Digital processing unit 32 may be a digital computer, a microcomputer or any other device which provides digital data.

The truth table for digital processing unit 32 to control switch 30 is as follows:

TABLE I

| Control Input | | Signal Path State | |
|---|---|---|---|
| A | B | RF to RF1 | RF to RF2 |
| High | Low | ON | OFF |
| Low | High | OFF | ON |

At this time it should be noted that only the signal path RF to RF1 is being used in the embodiment illustrated in FIG. 1.

Figure 2:
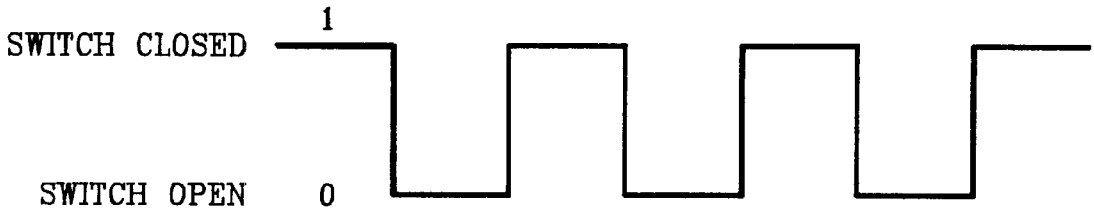
FIG. 2 illustrates one waveform provided by the variable scattering device of FIG. 1.

Referring to FIGS. 1 and 2, for a half wavelength dipole antenna, when digital processor 32 provides a logic one to the A control input of switch 30 and a logic zero to the B control input of switch 30, the switch 30 closes resulting in a logic one (FIG. 2) in the transmitted RF waveform 34 from device 20. When digital processor 32 provides a logic zero to the A control input of switch 30 and a logic one to the B control input of switch 30, the switch 30 opens resulting in a logic zero (FIG. 2) in the output waveform 34 from scattering device 20.

When, for example, the desired output waveform provided is 1011, digital processor 32 will supply to the A control input of switch 30 the bit pattern 1011 and also supply to the B control input of switch 30 the bit pattern 0100. Switch 30 is now being utilized to provide the digital identification code 1011 to antenna 24 which then transmits the identification code 1011 to a receiving antenna 36 via transmitted RF waveform 34.

The transmitted RF waveform 34 is produced by the reflection properties which are a function of the structural mode scattering and antenna mode scattering characteristics of antenna 24 arising from currents on the surface of antenna 24 and currents in the impedance connection terminals 25 and 29 induced by the incident signal 26. The characteristics of signal 34 are dependent upon the incident signal's frequency, polarization and direction.

Selecting the optimal impedance value for impedance 28 produces currents at terminals 25 and 29 of the scattering device 24 that have sufficient phase and amplitude to cancel the structural currents on the body of scattering device 20 resulting in a minimal scattered signal. The impedance value for impedance 28 which produces minimal scattering is identified as the optimal load impedance. Selecting the optimal load impedance value for impedance 28 and switching it in and out of the circuit with antenna 24 through switch 30 produces a scattering signal with maximized dynamic range from maximum to minimum scattering. Use of an optimal load in the arrangement of FIG. 1 may provide a 10–20 dB greater dynamic range in the reflected waveform 34 than that produced by a non-optimal load impedance such as an open circuit load.

Figure 3:
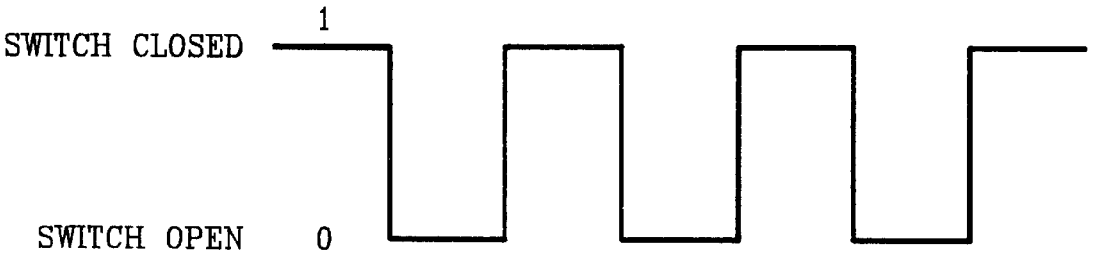
FIG. 3 illustrates a second waveform provided by the variable scattering device of FIG. 1.

Referring to FIGS. 1 and 3, variable scattering device 20 generates the waveform illustrated in FIG. 3 when the antenna 20 is a full wave length dipole antenna and the inductor 28 has a reactance of approximately 200 Ohms. The waveform illustrated in FIG. 3 has an amplitude which ranges from one to zero. It should be noted that a half wave length dipole antenna and a full wave length dipole antenna produce approximately the same waveform in amplitude and phase. By selecting the optimal impedance for the antenna, an enhancement of the waveform dynamic range is achieved.

Figure 4:
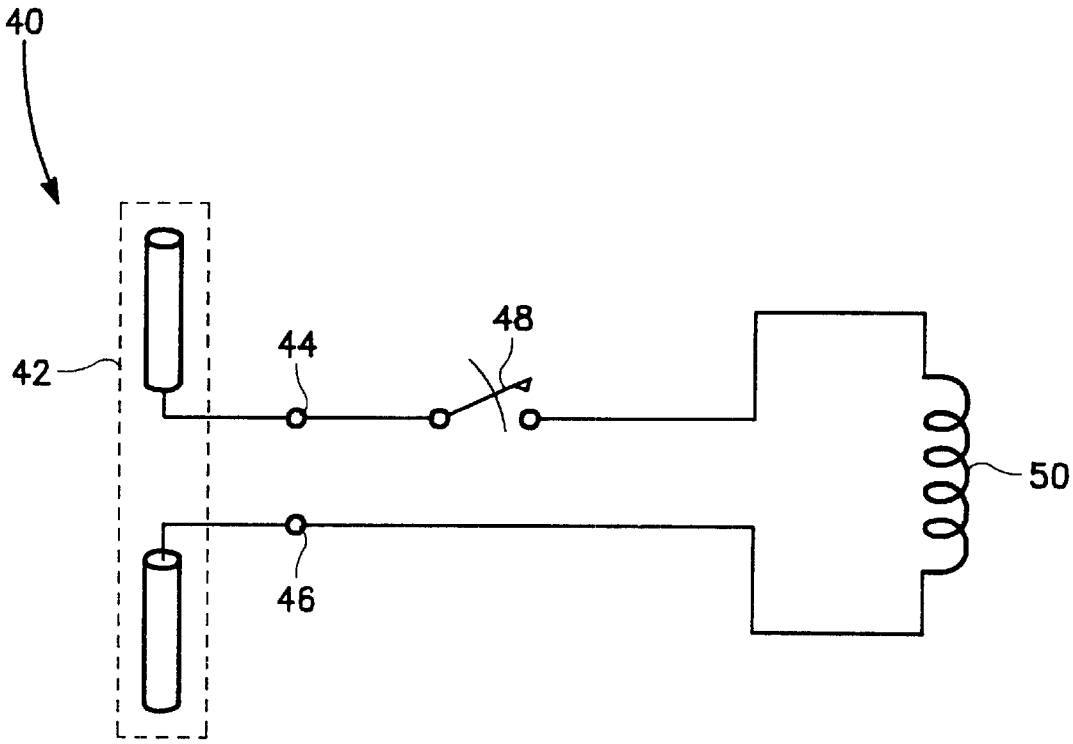
FIG. 4 is an electrical schematic diagram of a second embodiment of the variable scattering device comprising the present invention.
Figure 5:
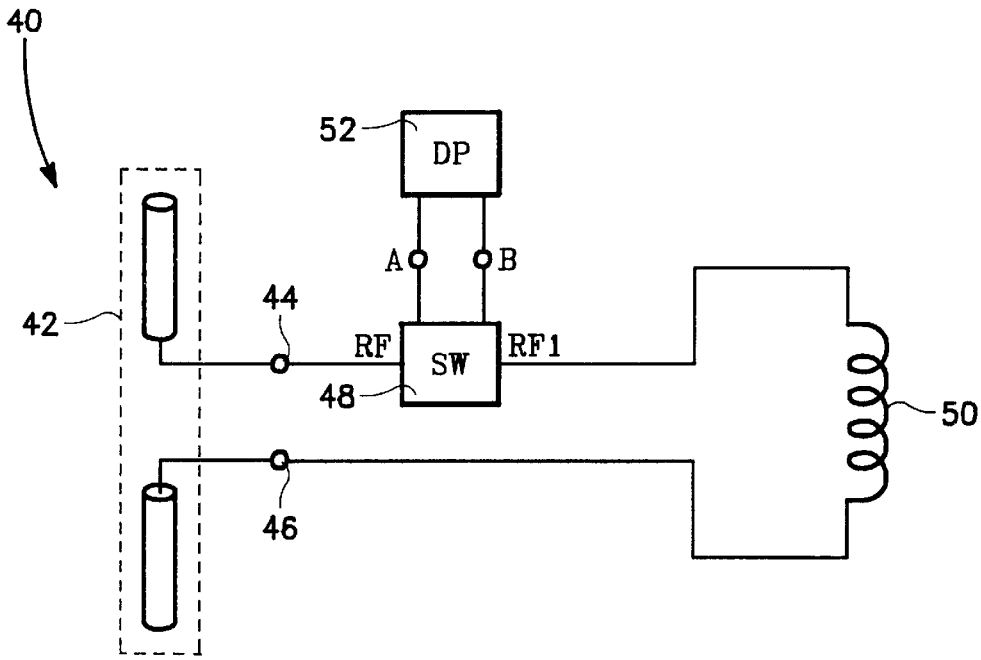
FIG. 5 is an electrical schematic diagram of the second embodiment of the variable scattering device illustrated in FIG. 4 wherein a digital processor is connected to the switch of FIG. 4.

Referring to FIGS. 4 and 5, there is shown alternate embodiments of the variable scattering device which is designated generally by the reference numeral 40. Variable scattering device 40 includes an antenna 42 which operates as the scattering device, a switch 48 and a load impedance 50. Antenna 42 is electrically connected to switch 48 and inductor 50 by a pair of terminals 44 and 46.

In FIGS. 4 and 5, the switch 48 is electrically connected in series to the load impedance 50, while FIG. 1 depicts the switch 30 as being electrically connected in parallel to the load impedance 28. In FIGS. 4 and 5, switch 48 opens the circuit connecting antenna 42 to load impedance 50. In FIG. 1, switch 30 shorts the electrical connection between the antenna 24 and load impedance 28.

As depicted in FIG. 5, the switch 48 may be a high isolation switch such as the switch 30 of FIG. 1. When the switch 48 is a high insolation switch a digital processor 52 is connected to the A and B control inputs of switch 48 to provide logic signals to switch 48 which open and close switch 48. The signal flow path through switch 48 is from the RF input of switch 48 to the RF1 output of switch 48.

Figure 6:
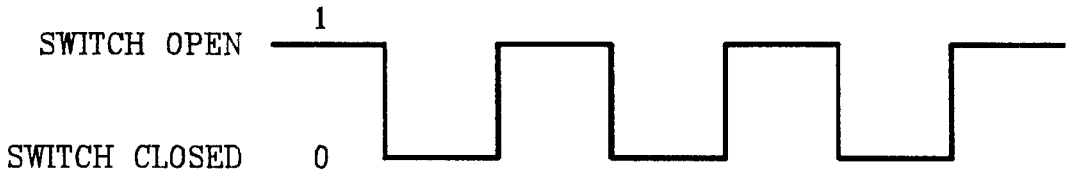
FIG. 6 is a waveform provided by the variable scattering device of FIG. 4.

At this time it should be noted that the waveform of FIG. 6 is the waveform generated by the circuit of FIG. 5 and in particular the combination of switch 48 and digital processor 52 whenever a reflection occurs at antenna 42.

Referring to FIG. 4, the switch 48 may be a mechanical, gravity activated switch such as a mercury switch. Switch 48 may be fabricated from a material having electrochemical properties to activate a conductive path between the antenna 42 and the load impedance 50. Further, materials that are photonically triggered to conduct electricity may be used in fabricating switch 48. Since switch 48 is providing a connection to the load impedance 50, which is typically a passive impedance loading, digital information, transmitted via an RF signal (e.g. signal 34, FIG. 1) requires low power from the scatter object. This low power requirement may be useful in a number of applications such as chaff, personnel beacons, and cell phones that signals via reflections.

Chaff is typically composed of numerous thin dipole elements cut to varying lengths to be resonant at different frequencies. When chaff is disbursed from an aircraft, a plurality of dipole elements are ejected which attempt to provide a scattering signal to direct a radar guided missile in the direction of the chaff and away from the aircraft. However, since the chaff slows down significantly, airborne radar systems are able to differentiate chaff from aircraft because of the relatively low Doppler frequency of the chaff. Applying the architecture of the embodiments of the invention as illustrated in FIGS. 1, 4 and 5 to chaff would enable the chaff to produce a Doppler frequency response sufficient to attract the missile 's seeker from the aircraft toward the chaff.

When used as a Doppler test calibration apparatus, the opening and closing of the electronic switch may be programmed using a digital signal processor to simulate the Doppler frequency of the equipment to be tested such as a helicopter rotor. The large dynamic range of the scattered signal generated by variable scattering device 20 (FIG. 1) or variable scattering device 40 (FIGS. 4 and 5) enables a strong calibration to be achieved.

At this time, it should be noted that more than one load impedance may be connected to the scattering object through the switch. For example, multiple loads on a dipole would require only that the dipole be cut at each interface providing terminals for the switch and load impedance connections. It should also be noted that other scattering devices such as loop antennas, fat dipole antennas, bicone antennas, horn antennas may be used in the electrical circuits illustrated in FIGS. 1, 4 and 5.

Wireless radio frequency identification tags currently under development at the Pacific Northwest National Laboratory at Richland, Wash. may also be adapted to the architecture of the embodiments of the invention as illustrated in FIGS. 1, 4 and 5 to enhance the operational capability of the tags.

From the foregoing it may readily be seen that the present invention comprises a new, unique and exceedingly useful variable scattering device which constitutes a considerable improvement over the known prior art. Obviously, many modifications of the present invention are possible in light of the above teachings. It is therefore to be understood that within the scope of the appended claims that the invention may be practiced otherwise than as specifically described.

What is claimed is:

1. A variable scattering apparatus comprising:

reflecting means for receiving an incident electromagnetic signal from an external source and reflecting said incident electromagnetic signal therefrom;

an impedance having a reactance value which achieves minimum back scattering of said incident electromagnetic signal when said incident electromagnetic signal is reflected from said reflecting means;

switching means for electrically connecting said impedance to said reflecting means and for disconnecting said impedance from said reflecting means;

digital processing means for generating a digital code comprising a plurality of digital bits, said digital processing means providing said digital code to said switching means; and said switching means, responsive to the digital bits of said digital code, connecting said reflecting means to said impedance and disconnecting said reflecting means from said impedance resulting in a reflection of said incident electromagnetic signal from said reflecting means which includes digital information.

2. The variable scattering apparatus of claim 1 wherein said reflecting means comprises a half wave length dipole antenna and said impedance comprises an inductor which has a positive reactance of approximately 300 Ohms.

3. The variable scattering apparatus of claim 1 wherein said reflecting means comprises a full wave length dipole antenna and said impedance comprises an inductor which has a positive reactance of approximately 200 Ohms.

4. The variable scattering apparatus of claim 1 wherein the digital information included in the reflection of said incident electromagnetic signal comprises a digital identification code.

5. The variable scattering apparatus of claim 1 wherein said digital processing means comprises a digital computer.

6. The variable scattering apparatus of claim 1 wherein said switching means comprises a single pole double throw switch.

7. The variable scattering apparatus of claim 1 wherein said switching means has a high isolation of greater than 50 dB over a bandwidth which is from DC to 15 GHz.

8. A variable scattering apparatus comprising:

an antenna for receiving an incident electromagnetic signal from an external source and reflecting said incident electromagnetic signal therefrom;

an impedance having a reactance value which achieves minimum back scattering of said incident electromagnetic signal when said incident electromagnetic signal is reflected from said reflecting means;

an RF switch connected to said impedance in a series configuration, said RF switch electrically connecting said impedance to said antenna when RF switch is closed, said RF switch disconnecting said impedance from said antenna when said RF switch is open;

a digital processor connected to said RF switch, said digital processor generating a digital code comprising a plurality of digital bits, said digital processor providing said digital code to said RF switch; and said RF switch, responsive to the digital bits of said digital code, closing to connect said antenna to said impedance and opening to disconnect said antenna from said impedance resulting in a reflection of said incident electromagnetic signal from said antenna including digital information.

9. The variable scattering apparatus of claim 8 wherein the reflection of said incident electromagnetic signal has an enhanced dynamic range of about 10 dB to about 20 dB when said impedance has an optimal value for said antenna.

10. The variable scattering apparatus of claim 9 wherein said antenna comprises a half wave length dipole antenna and the impedance comprises an inductor which has a positive reactance of approximately 300 Ohms.

11. The variable scattering apparatus of claim 9 wherein said antenna comprises a full wave length dipole antenna and the impedance comprises an inductor which has a positive reactance of approximately 200 Ohms.

12. The variable scattering apparatus of claim 8 wherein the digital information included in the reflection of said incident electromagnetic signal comprises a digital identification code.

13. The variable scattering apparatus of claim 8 wherein said digital processor comprises a digital computer.

14. The variable scattering apparatus of claim 8 wherein said RF switch comprises a single pole double throw switch.

15. The variable scattering apparatus of claim 8 wherein said RF switch has a high isolation of greater than 50 dB over a bandwidth which is from DC to 15 GHz.

16. A variable scattering apparatus comprising:

an antenna for receiving an incident electromagnetic signal from an external source and reflecting said incident electromagnetic signal therefrom;

an impedance having a reactance value which achieves minimum back scattering of said incident electromagnetic signal when said incident electromagnetic signal is reflected from said reflecting means;

an RF switch connected to said impedance in a parallel configuration, said RF switch electrically connecting said impedance to said antenna when RF switch is open, said RF switch disconnecting-said impedance from said antenna when said RF switch is closed;

a digital processor connected to said RF switch, said digital processor generating a digital code comprising a plurality of digital bits, said digital processor providing said digital code to said RE switch; and said RF switch, responsive to the digital bits of said digital code, opening to connect said antenna to said impedance and closing to disconnect said antenna from said impedance resulting in a reflection of said incident electromagnetic signal from said antenna including digital information, the reflection of said incident electromagnetic signal having an enhanced dynamic range of about 10 dB to about 20 dB.

17. The variable scattering apparatus of claim 16 wherein the reflection of said incident electromagnetic signal has an enhanced dynamic range of about 10 dB to about 20 dB when said impedance has an optimal value for said antenna.

18. The Variable scattering apparatus of claim 17 wherein said antenna comprises a half wave length dipole antenna and the impedance comprises an inductor which has a positive reactance of approximately 300 Ohms.

19. The variable scattering apparatus of claim 17 wherein said antenna comprises a full wave length dipole antenna and the impedance comprises an inductor which has a positive reactance of approximately 200 Ohms.

20. The variable scattering apparatus of claim 16 wherein the digital information included in the reflection of said incident electromagnetic signal comprises a digital identification code.

21. The variable scattering apparatus of claim 16 wherein said digital processor comprises a digital computer.

22. The variable scattering apparatus of claim 16 wherein said RF switch comprises a single pole double throw switch.

23. The variable scattering apparatus of claim 16 wherein-said RF switch has a high isolation of greater than 50 dB over a bandwidth which is from DC to 15 GHz.

* * * * *